United States Patent [19]

Biesinger

[11] Patent Number: 4,753,090

[45] Date of Patent: Jun. 28, 1988

[54] DEVICE FOR PROCESSING LEATHER OR HIDE PRODUCTS

[76] Inventor: Erwin Biesinger, Herderstrasse 10, 7407 Rottenburg, Fed. Rep. of Germany

[21] Appl. No.: 917,798

[22] Filed: Nov. 10, 1986

[30] Foreign Application Priority Data

Oct. 10, 1985 [DE] Fed. Rep. of Germany ..... 3536122

[51] Int. Cl.[4] ..... C14C 15/00

[52] U.S. Cl. ..... 69/30; 68/140; 384/482

[58] Field of Search ..... 68/140; 69/29, 30; 384/482, 501

[56] References Cited

U.S. PATENT DOCUMENTS

| | | | |
|---|---|---|---|
| 2,655,392 | 10/1953 | Lighthau | 384/482 |
| 3,494,681 | 2/1970 | Anderson et al. | 384/482 |
| 3,918,277 | 11/1975 | Nakk | 68/140 |
| 4,519,224 | 5/1985 | Seifert et al. | 69/30 |

FOREIGN PATENT DOCUMENTS

| | | | |
|---|---|---|---|
| 3009562 | 9/1981 | Fed. Rep. of Germany . | |
| 3408664 | 9/1985 | Fed. Rep. of Germany | 384/482 |

*Primary Examiner*—W. Carter Reynolds
*Attorney, Agent, or Firm*—Michael J. Striker

[57] ABSTRACT

A device for processing leather or hide products includes one or a number of sieve drums openable at two end faces and supported in the housing of the device for rotation. The sieve drum is supported on the housing by means of a four point-contact bearing which is sealed against gaseous or fluidic medium filling the drum.

10 Claims, 2 Drawing Sheets

10
11
12
13
14
15
16
17
18
19
20
21
22
23
24
25
26
27
28
29
30
35
36
II

DEVICE FOR PROCESSING LEATHER OR HIDE PRODUCTS

BACKGROUND OF THE INVENTION

The present invention relates to a device for processing goods, particularly leather or hide products, of the type having a housing in which at least one rotating sieve drum for receiving goods to be processed is supported.

Processing devices of the type under discussion have been known. One of such devices is disclosed for example in the German Offenlegungschrift No. 3,009,562. In such devices, the sieve drum is provided at both end sides thereof with openings of which one opening serves the purpose of feeding goods being treated into the drum and the other opening ensures a direct shifting of the goods into a second processing device, specifically drying device. In order to solve the problem of supporting such rotatable sieve drum it has been proposed to support the peripheral surface of the drum on the rollers or magnetic cushions. Both solutions however are very expensive. The roller supports must be formed in the interior of the housing which is frequently refilled with liquid so that in addition to the expensive construction there is a danger of troubles caused by parts of the goods being processed which can fall out from the sieve drum.

SUMMARY OF THE INVENTION

It is an object of the present invention to provide an improved device for processing leather or hide products.

It is another object of the invention to provide a device for treating leather or hide goods with a drum having openings at two end sides thereof and supported within the housing of the device by an inexpensive and trouble-free supporting arrangement.

These and other objects of the invention are attained by a device for processing goods, particularly leather or hide products, comprising a housing; at least one rotatable sieve drum for receiving goods being processed and supported in said housing, said drum having at two opposite sides thereof two openings for feeding said goods into and discharging said goods from said drum, respectively; means for supporting said drum in said housing, said supporting means including a play-free four point-contact bearing positioned in said housing and receiving radial and axial forces acting on said drum and being offset radially outwardly from one of said openings for forming said one opening; and sealing means provided in the region of said bearing for sealing the housing against gas and liquid outwardly.

The device may further include a ring-shaped element for limiting said one opening, a drive ring cooperating with an external drive and coaxial with said ring-shaped element and connected to the latter, a housing stationary portion concentrical with said opening, and a closing ring connected to said housing stationary portion, said bearing including two wire rings at two contact points thereof, which are positioned in said drive ring, and two wire rings at two other contact points, which are positioned at said stationary housing portion and said closing ring, respectively.

The four-point contact bearing can be formed as a so-called wire bearing which includes four wire rings supported at the respective parts of the device, and bearing balls running between said wire rings.

The play-free four point contact bearing can be formed as a ball bearing in which balls are positioned between two bearing rings.

In the processing device of this invention, a play-free bearing of the sieve drum which takes up loadings and prevents penetration of gaseous or fluidic medium contained in the housing into the bearing elements, is obtained.

The sealing means of this invention which particularly directly seal the four point-contact bearing are inexpensive to make and reliable in use.

The sealing means may include a sealing ring, provided at each side of said bearing, said bearing being sealed by said sealing rings, each sealing ring being anchored and slidably positioned at said drive ring and against a surface of at least said housing stationary portion.

The sealing means may further include a capillary aperture-sealing provided in the region of said one opening between said housing and said sieve drum, whereby a capillary gap is formed between a separating disc concentric with and connected to a wall of said drum and an inner wall of said housing, said capillary gap being limited by plastic coatings on said end wall and said separating disc.

The inner wall of the housing may form with an end wall of said housing a circular leakage chamber provided with a drain outwardly of said housing.

Processing liquid collected in the leakage chamber can be returned to the liquid circuit of the device.

The sealing means may further include a labyrinth sealing including two parallel spaced slinger rings provided on said drive ring and extended into said leakage chamber, and a separating ring rigidly connected to said housing stationary portion and extended between said slinger rings.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
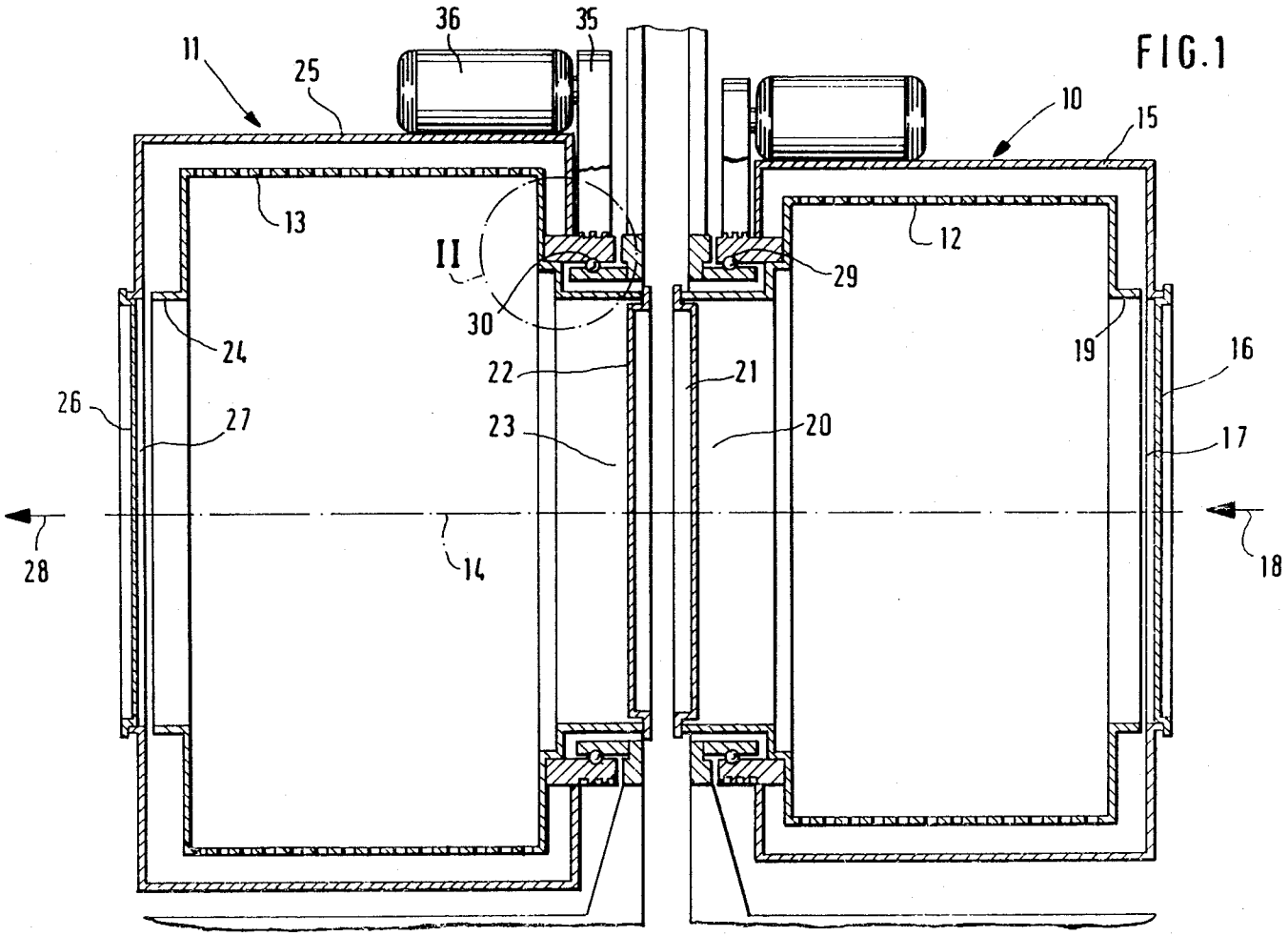
FIG. 1 is a schematic view of a combination of two devices for processing leather and hide goods according to the invention.

Referring now to the drawings in detail, FIG. 1 illustrates a combination of a device 10 for a chemical cleaning of leather or hide goods and a drying device 11. Both devices 10 and 11 are provided with sieve drums 12 and 13 which are coaxial with each other and have a common axis 14. The sieve drum 12 of the cleaning device 10 has a somewhat smaller volume than that of the sieve drum 13 of the drying device. A housing 15 of the cleaning device 10 has in the conventional fashion at an end face thereof a feeding opening 17 which is closable by a round door 16. Through the feeding opening 17, goods to be processed, for example leather goods, are fed in the direction of arrow 18 into the sieve drum 12 which has a corresponding feeding opening 19 also provided at the end face thereof. The sieve drum 12 further has an opening 20 at its other end face. Opening 20 is in turn closable by means of a revolving door 21 and is a discharge opening. An opening 23 of the sieve drum 13, which is closable by a revolving door 22, is positioned against opening 20. The sieve drum 13 has at the end face thereof opposite to opening 23 a non-closable opening 24 which corresponds to opening 19 of the sieve drum 12 of the cleaning device. A housing 25 of the drying device 11 has in turn an opening 27 closable by a door 26 and positioned against opening 24. Opening 27 corresponds to the opening 17 of the housing 15 of the cleaning device 10. It is therefore clear that the cleaning device 10 and the drying device 11 are substantially identical and mirror-inverted relative to each other. In the drying device 11 the closable opening 23 is a feeding opening through which the goods being treated and discharged from the cleaning device 10 enter the sieve drum 13 of the drying device 11 whereas the housing opening 27 of the drying device 11 is a discharge opening through which dried goods being processed are removed from the drying device in the direction shown by arrow 28.

In both devices 10 and 11, the sieve drums 12 and 13 at the sides of their closable openings 20 and 23 are guided outwardly from the respective housings 15 and 25 and supported in these regions of the housings 15 and 25 by schematically illustrated play-free ball bearings 29 and 30. The structure of the bearings and their sealing arrangement are shown in detail in FIG. 2.

Figure 2:
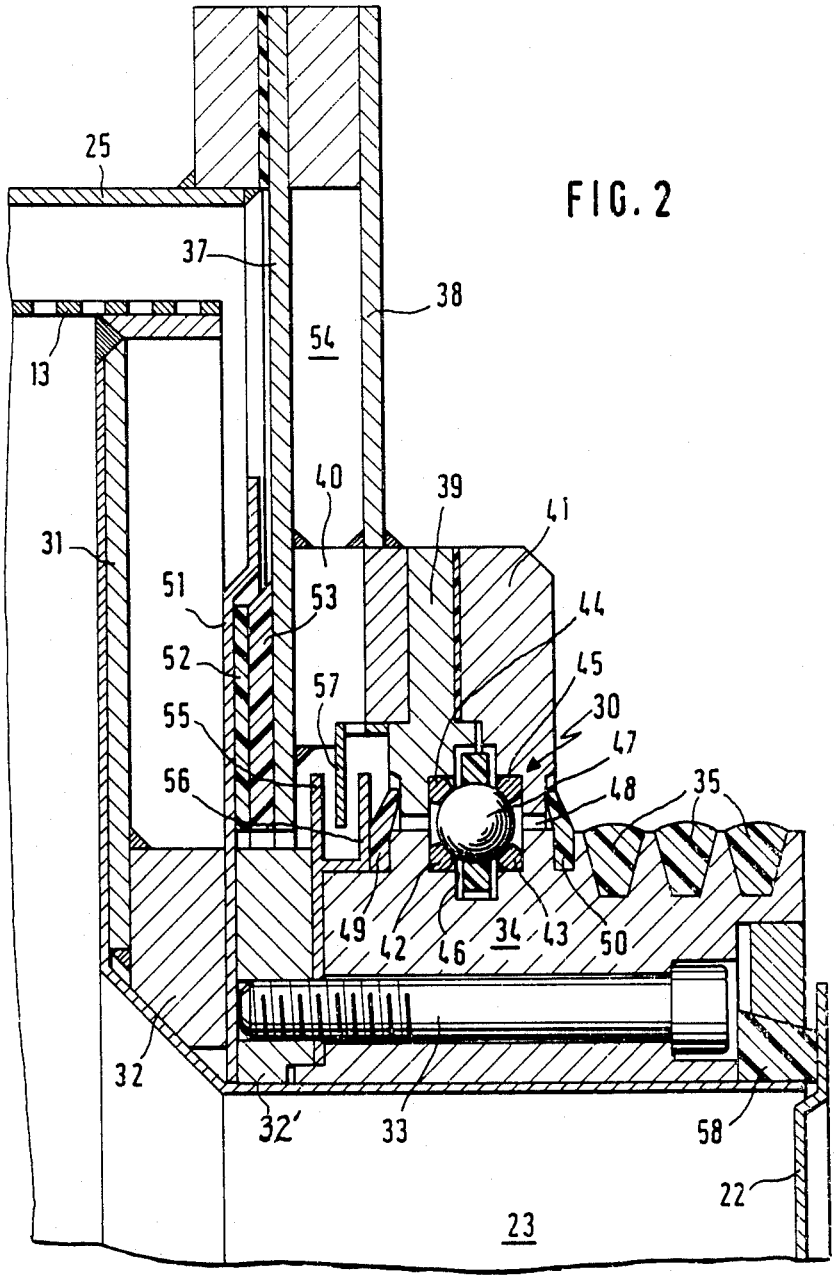
FIG. 2 is an axial sectional view through a bearing region of one of the devices, designated by II in FIG. 1.

FIG. 2 depicts the bearing region of one sieve drum only. It is of course understood that both sieve drums have in the regions of their support identical sealing arrangements. Such sealing arrangement is sufficient not only for the drying device 11 but also for the device for chemical cleaning of the goods being processed, operated with chemical liquids. As noted above reference numeral 25 designates the housing of the drying device 11 and reference numeral 22 denotes the door of the sieve drum 13. The latter is provided at the side of the bearing with an end wall ring 31 which terminates with a ring-shaped clement 32 at the opening 23 of the sieve drum 13. A drive ring 34 is rigidly connected to a ring-shaped element 32' by bolts 33. The ring-shaped elements 32 and 32' are connected with one another by not shown screws. A four point-contact bearing 30 and various sealings are on the drive ring 34. The latter has an outwardly extending end portion formed with three wedge-shaped grooves for receiving wedge-type belts 35 of the driving device connected with an output shaft of a respective drive motor 36 shown in FIG. 1.

In the exemplified embodiment depicted in FIG. 2, the play-free four point-contact bearing 30 is comprised of four wire rings 42, 43, 44 and 45. Two wire rings 42 and 43 are positioned in the corners of a recess 46 formed in the drive ring 34. The wire ring 44 is situated at a shoulder formed on a housing ring-shaped projection 39 whereas the wire ring 45 is supported against the shoulder of a closing ring 41. Balls 47 of the four point-contact bearing 30 which is completely play-free run between four wire rings 42 through 45.

A clearance 48 between the rotatable driving ring 34 and the stationary housing ring or projection 39 is sealed at the four point-contact bearing 30 by means of sealing rings 49 and 50 received in respective grooves provided in the drive ring 34. Sealing rings 49 and 50 slide along the side walls of the housing ring 39 and closing ring 41.

A capillary-aperture sealing is formed between the sieve drum 13 and an inner end wall 37 of the housing 25. For this purpose a separating circular disc 51 is arranged between to the ring-shaped elements 32'. This disc is provided at an other face thereof with a circular coating or layer 52 of a suitable plastic material. A plastic coating or layer 53 applied to the inner surface of the housing wall 37 lies against the layer 52. Both plastic layers 52 and 53 limit a capillary gap or aperture. A cylindrical intermediate space 54 between the inner housing wall 37 and outer housing wall 38 forms on the underside of the housing 25 a leakage space with a drain. The liquid passing through the capillary gap is collected in that leakage space and can be removed therefrom. The leakage space 54 of the housing is provided with a labyrinth sealing for sealing the bearing location of the sieve drum. This labyrinth sealing is formed by two parallel slinger rings 55 and 56 arranged on the drive ring 34 and rotatable therewith, and a separation ring 57 connected to the housing portion 39 and extending between slinger rings 55 and 56. The drive ring 34 limits the opening 23 of the sieve drum 13 and supports a door sealing ring 58 for the revolving door 22.

It will be understood that each of the elements described above, or two or more together, may also find a useful application in other types of devices for processing leather or hide products differing from the types described above.

While the invention has been illustrated and described as embodied in a device for processing leather or hide products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for processing goods, particularly leather or hide products, comprising a housing; at least one rotatable sieve drum for receiving goods being processed and supported in said housing, said drum having at two opposite sides thereof two openings for feeding said goods into and discharging said goods from said drum, respectively; means for supporting said drum in said housing, said supporting means including a play-free four point-contact bearing positioned in said housing and taking up radial and axial forces acting on said drum and being offset radially outwardly from one of said openings; and sealing means provided in the region of said bearing for sealing said housing against gas and liquid.

2. The device as defined in claim 1, further including a ring-shaped element for limiting one of said openings, a drive ring cooperating with an external drive and coaxial with said ring-shaped element and connected to the latter, a housing stationary portion concentrical with said one opening, and a closing ring connected to said housing stationary portion, said bearing including two wire rings at two contact points thereof, which are positioned in said drive ring, and two wire rings at two other contact points, which are positioned at said stationary housing portion and said closing ring, respectively.

3. The device as defined in claim 2, wherein said sealing means includes a sealing ring which is mounted on said drive ring, said one opening being closable by a door which tightly lies on an end face of said sealing ring in a closed position.

4. The device as defined in claim 3, wherein said sealing means include a sealing ring (49, 50) provided at each side of said bearing, said bearing being sealed by said sealing rings, each sealing ring being anchored and slidably positioned at said drive ring and against a surface of at least said housing stationary portion and said closing ring.

5. The device as defined in claim 4, said sealing means further including a capillary gap-sealing provided in the region of said one opening between said housing and said sieve drum, whereby a capillary gap is formed between a separating disc (51) concentric with and connected to a wall (31) of said drum and an inner wall (37) of said housing, said capillary gap being limited by plastic coatings on said end wall and said separating disc.

6. The device as defined in claim 5, wherein a capillary gap is formed at said inner wall (37) of said housing, said inner wall forming with an end wall (38) of said housing a circular leakage chamber.

7. The device as defined in claim 6, sealing means further including a labyrinth sealing including two parallel spaced slinger rings (55, 56) provided on said drive ring and extended into said leakage chamber, and a separating ring (57) rigidly connected to said housing stationary portion and extended between said slinger rings.

8. The device as defined in claim 1, wherein the other of said openings of said housing is closable by a door.

9. The device as defined in claim 2, wherein said four point-contact bearing is formed as a ball bearing.

10. The device as defined in claim 1, wherein said bearing includes four wire rings and balls positioned therebetween.

* * * * *